US009972233B2

(12) United States Patent
Lim

(10) Patent No.: US 9,972,233 B2
(45) Date of Patent: May 15, 2018

(54) DISPLAY DEVICE AND METHOD OF DRIVING THE SAME

(71) Applicant: Samsung Display Co., Ltd., Yongin (KR)

(72) Inventor: Kyoung Ho Lim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 410 days.

(21) Appl. No.: 14/696,944

(22) Filed: Apr. 27, 2015

(65) Prior Publication Data

US 2016/0196774 A1 Jul. 7, 2016

(30) Foreign Application Priority Data

Jan. 6, 2015 (KR) ..... 10-2015-0001207

(51) Int. Cl.
*G09G 3/20* (2006.01)

(52) U.S. Cl.
CPC ..... *G09G 3/20* (2013.01); *G09G 2320/04* (2013.01); *G09G 2340/045* (2013.01); *G09G 2340/0414* (2013.01); *G09G 2340/0421* (2013.01); *G09G 2380/02* (2013.01)

(58) Field of Classification Search
CPC ..... G09G 3/20; G09G 2320/04; G09G 2340/0414; G09G 2340/0421; G09G 2340/045; G09G 2380/02
See application file for complete search history.

(56) References Cited

U.S. PATENT DOCUMENTS 5,321,505 A * 6/1994 Leddy ..... H04N 7/18 345/505
6,115,092 A * 9/2000 Greene ..... G06F 3/147 345/88
7,982,379 B2 7/2011 Krans et al.
2001/0006375 A1* 7/2001 Tomooka ..... G06F 3/1446 345/4
2004/0233125 A1* 11/2004 Tanghe ..... G06F 3/1446 345/1.3
2006/0044215 A1* 3/2006 Brody ..... G06F 3/1446 345/1.3

(Continued)

FOREIGN PATENT DOCUMENTS

KR 10-1999-0011354 2/1999
KR 10-2009-0019897 2/2009
KR 10-2014-0044237 4/2014

*Primary Examiner* — Ariel Balaoing
(74) *Attorney, Agent, or Firm* — H.C. Park & Associates, PLC

(57) ABSTRACT

A display device including a display panel including scan lines, data lines, and first pixels disposed thereon, an expansion detecting unit configured to determine expansion of the display panel, a control unit configured to generate a control signal to correct an image signal depending on a degree of expansion when the display panel is determined to be expanded, a scan driver connected to the scan lines and configured to apply the control signal to the scan lines connected to the corresponding pixels depending on the control signal input from the control unit, and a data driver connected to the data lines and configured to apply the control signal to the data lines connected to the corresponding pixels depending on the control signal input from the control unit.

20 Claims, 11 Drawing Sheets

(56) References Cited

U.S. PATENT DOCUMENTS

| | | | | |
|---|---|---|---|---|
| 2006/0061516 | A1* | 3/2006 | Campbell | G06F 3/1431 345/1.1 |
| 2007/0018170 | A1* | 1/2007 | Jeong | G02F 1/13454 257/72 |
| 2014/0098028 | A1 | 4/2014 | Kwak et al. | |

* cited by examiner

DISPLAY DEVICE AND METHOD OF DRIVING THE SAME

CROSS-REFERENCE TO RELATED APPLICATION

This application claims priority from and the benefit of Korean Patent Application No. 10-2015-0001207, filed on Jan. 6, 2015, which is hereby incorporated by reference for all purposes as if fully set forth herein.

BACKGROUND

Field

Exemplary embodiments of the present invention relate to a display device, and more particularly, to a display device including a flexible material and a method of driving the same.

Discussion of the Background

Demand for small and light flat-panel display device has been increasing, as a flat-panel display device may be used in display devices such as, a TV, a PC, a laptop computer, a tablet PC, a mobile phone, and an MP3 player. A type of a flat-panel display device that meets user demands has been studied. A flexible display device may be bent or folded by users.

In some cases, a display panel of the flexible display device may be expanded by external force.

When the display panel is expanded, pixels of the display panel may also expand to distort the image displayed in the expanded area.

The above information disclosed in this Background section is only for enhancement of understanding of the background of the inventive concept, and, therefore, it may contain information that does not form the prior art that is already known in this country to a person ordinary skill in the art.

SUMMARY

Exemplary embodiments of the present invention provide a display device that may prevent the degradation of display quality in a flexible display device by detecting the degree of expansion of the display panel, to correct an image depending on the degree of expansion.

Exemplary embodiments of the present invention also provide a method of driving the display device that may prevent the degradation of display quality in a flexible display device by detecting the degree of expansion of the display panel, to correct an image depending on the degree of expansion.

Additional aspects will be set forth in the detailed description which follows, and, in part, will be apparent from the disclosure, or may be learned by practice of the inventive concept.

According to an exemplary embodiment of the present invention a display device includes a display panel including scan lines, data lines, and first pixels disposed thereon, an expansion detecting unit configured to determine expansion of the display panel, a control unit configured to generate a control signal to correct an image signal depending on a degree of expansion when the display panel is determined to be expanded, a scan drive unit connected to the scan lines and configured to apply the control signal to the scan lines connected to the corresponding pixels depending on the control signal input from the control unit, and a data drive unit connected to the data lines and configured to apply the control signal to the data lines connected to the corresponding pixels depending on the control signal input from the control unit.

According to an exemplary embodiment of the present invention, a display device includes a display panel including scan lines, data lines, and pixels disposed on the display panel in a region defined by the scan lines and the data lines, an expansion detecting unit configured to determine expansion of the display panel, a control unit configured to generate a control signal and control the operation of a scan drive unit and a data drive unit depending on a degree of expansion when the display panel is determined to be expanded, in which the scan drive unit is connected to the scan lines and configured to apply the control signal to the scan lines connected to the corresponding pixels depending on the control signal input from the control unit, the a data drive unit is connected to the data lines and configured to apply the control signal to the data lines connected to the corresponding pixels depending on the control signal input from the control unit, and the scan drive unit and the data drive unit are configured to control a timing of a scan signal or a data signal applied to the display panel depending on the degree of expansion of the display panel.

According to an exemplary embodiment of the present invention, a method of driving a display device includes determining whether the display panel is expanded by an external force, comparing a reference set value with a calculated value to determine a degree of expansion in response to determining the display panel is expanded, scaling an image signal when the reference set value is greater than the calculated value, and increasing a resolution of the image signal when the reference set value is smaller than the calculated value.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
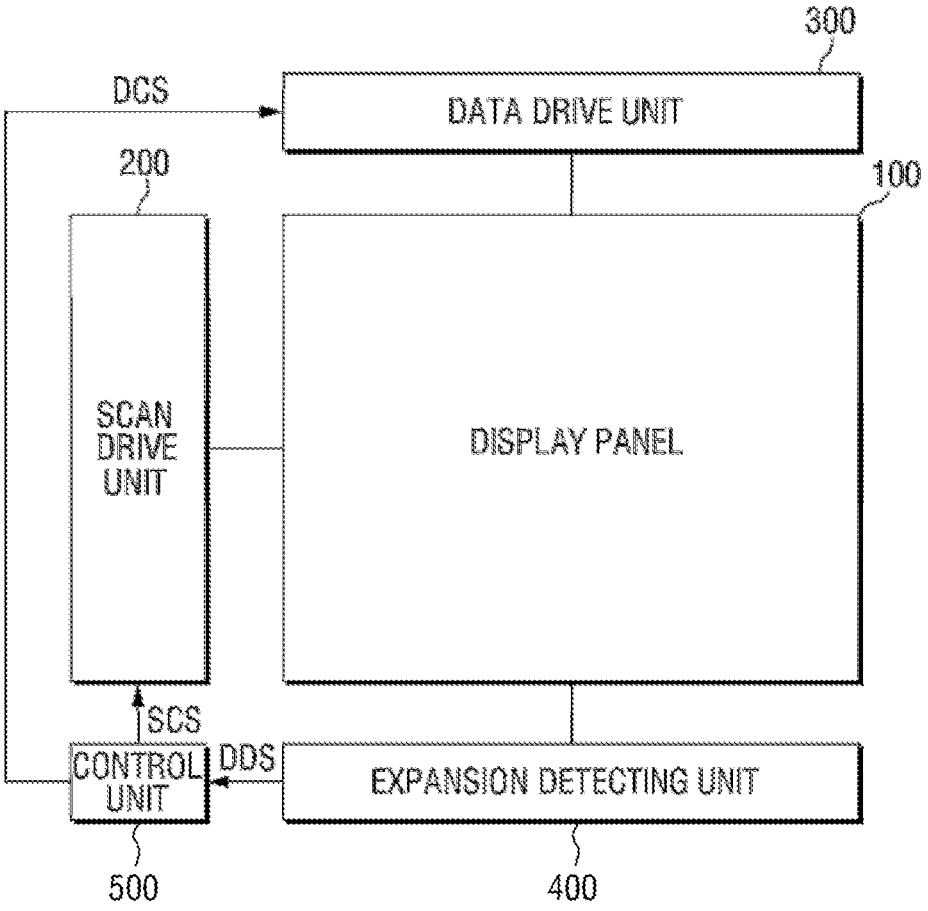
FIG. 1 is a block diagram schematically illustrating a display device according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarify and descriptive purposes. Also, like reference numerals denote like elements.

It will be understood that when an element or layer is referred to as being "on", "connected to", or "coupled to" another element or layer, it can be directly on, directly connected to, or directly coupled to the other element or layer, or intervening elements or layers may be present. In contrast, when an element is referred to as being "directly on," "directly connected to", or "directly coupled to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ). As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a block diagram schematically illustrating a display device according to an exemplary embodiment of the present invention.

Referring to FIG. 1, a display device according to an exemplary embodiment of the present invention may include a display panel 100, a scan drive unit 200, a data drive unit 300, an expansion detecting unit 400, and a control unit 500.

The display panel 100 may be a region on which an image is displayed, and scan lines, data lines, and pixels may be arranged therein. The display panel 100 may be disposed on a flexible substrate. The flexible substrate may be deformed by external pressure and be made of a material such as glass, metal, polyimide (PI), polycarbonate (PC), polyethylene terephthalate (PET), polyether sulfone (PES), polyethylene naphthalate (PEN), and fiber reinforced plastic (FRP). The flexible substrate may further include a coating for maintaining flexibility in addition to the above-described materials forming the flexible substrate. As the display panel 100 is disposed on the flexible substrate, the display panel 100 may be expanded by external force. The expansion of the display panel 100 will be described in more detail with reference to FIGS. 2 and 3 below.

The scan drive unit 200 may apply a signal to a scan line connected to the corresponding pixel among scan lines arranged on the display panel 100, in response to receiving a scan drive control signal (SCS) from the control unit 500. The scan drive unit 200 may be disposed in an external region of the display panel 100 and electrically connected to the display panel 100 by first signal lines. The scan drive unit 200 may be formed of a rigid material. Accordingly, when the display panel 100 is expanded by the external force, the scan drive unit 200 may expand. Meanwhile, the first signal lines for electrically connecting the scan drive unit 200 and the display panel 100 may be made of a flexible material.

The data drive unit 300 may apply a signal to a data line connected to the corresponding pixel among the data lines arranged on the display panel 100, in response to receiving a data drive control signal (DCS) from the control unit 500. The data drive unit 300 may be disposed in an external region of the display panel 100 and electrically connected to the display panel 100 by second signal lines. The data drive unit 300 may be made of a rigid material. Accordingly, when the display panel 100 is expanded by the external force, the data drive unit 300 may not expand. Meanwhile, the second signal lines for electrically connecting the data drive unit 300 and the display panel 100 may be made of a flexible material.

The expansion detecting unit 400 is disposed around the display panel 100 to detect whether the display panel 100 is expanded and a degree of expansion when the display panel 100 is expanded by the external force.

The control unit 500 may receive an image data from the outside, and generate control signals (SCS, DCS) that control the operation of the scan drive unit 200 and the data drive unit 300, to display the received image data on the display panel 100. The scan drive control signal SCS and the data drive control signal DCS applied to the scan drive unit 200 and the data drive unit 300 may include a image compensation control signal that may reflect compensation information on a resolution of image or on scaling of the image, and a timing control signal that may control the application timing of the drive signal according to the expansion, depending on the degree of expansion of the display panel 100.

Figure 2:
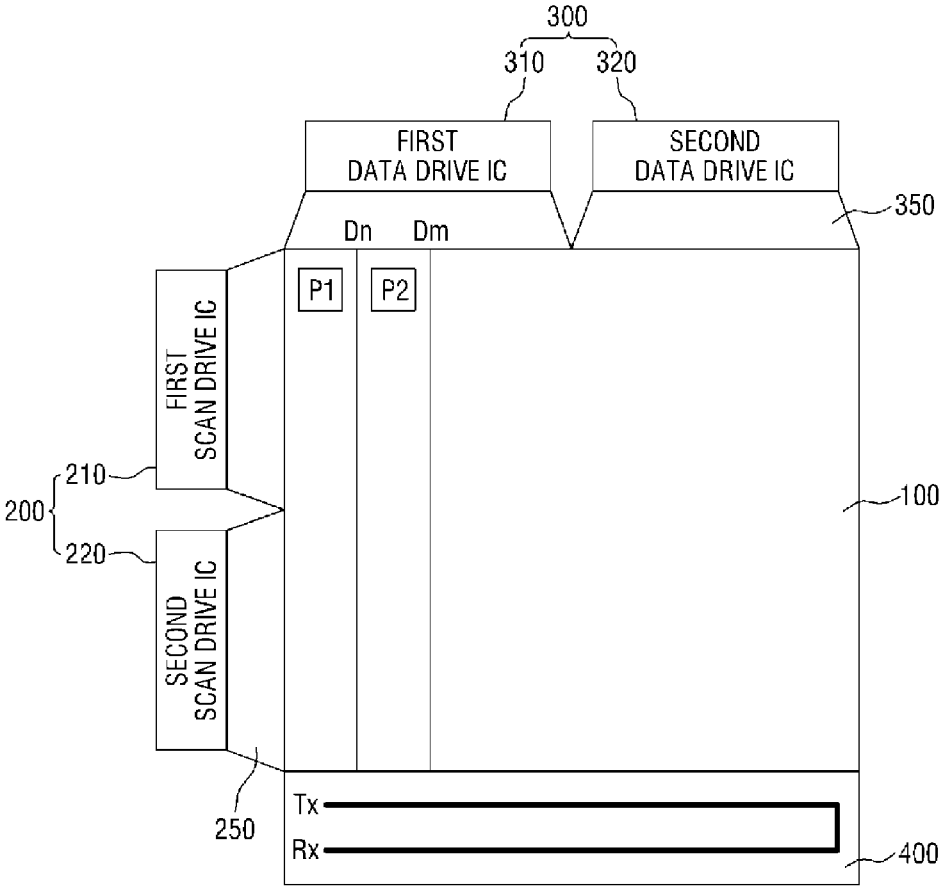
FIG. 2 is a plan view schematically illustrating a partial configuration before expansion of the display device of FIG. 1.
Figure 3:
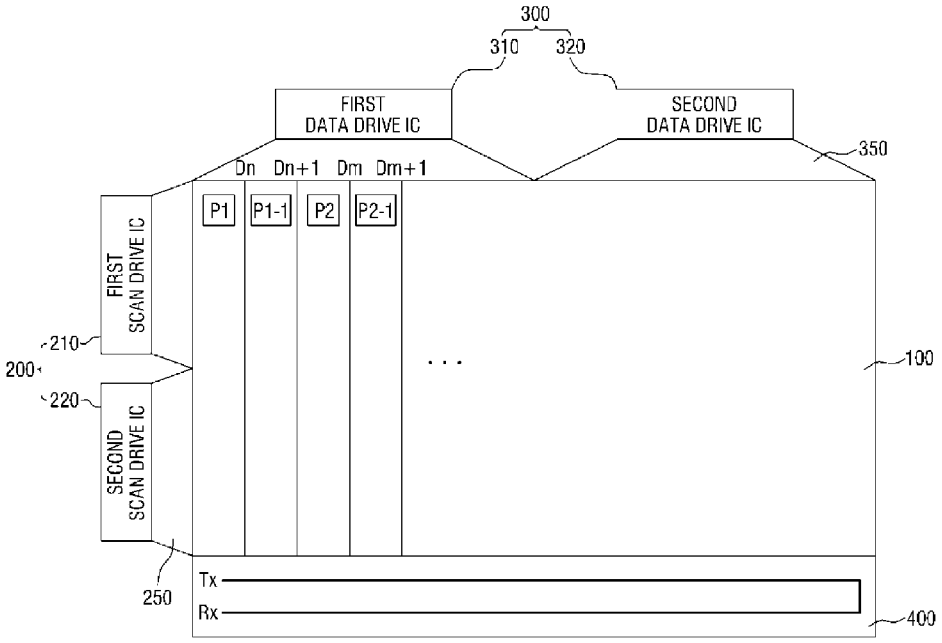
FIG. 3 is a plan view schematically illustrating a partial configuration after expansion of the display device of FIG. 1.

FIG. 2 is a block diagram schematically illustrating a partial configuration before the expansion of the display device of FIG. 1, and FIG. 3 is a block diagram schematically illustrating a partial configuration after the expansion of the display device of FIG. 1.

Referring to FIG. 2, the display panel 100 according to an exemplary embodiment of the present invention may include scan lines (not illustrated), data lines (Dn, Dm), and pixels (P1, P2) arranged in a region defined by the scan lines (not illustrated) and the data lines (Dn, Dm). In addition, an expansion detecting unit 400 may be disposed at the lower end of the display panel 100. The expansion detecting unit 400 may detect whether the display panel 100 is expanded by an external force and a degree of the expansion. The display panel 100 may be connected to the scan drive unit 200 by first signal lines 250 and connected to the data drive unit 300 by second signal lines 350. The scan drive unit 200 may include a first scan drive IC 210 and a second scan drive IC 220, and the data drive unit 300 may include a first data drive IC 310 and a second data drive IC 320.

The display panel 100 may include hidden data lines (Dn+1, Dm+1) arranged at different layers from the data lines (Dn, Dm) arranged on the flexible substrate. As illustrated in FIG. 2, when the display panel 100 is not expanded, the hidden data lines (Dn+1, Dm+1) arranged on the different layers are hidden from the display panel 100. However, when the display panel 100 is expanded as illustrated in FIG. 3, the hidden data lines (Dn+1, Dm+1) may appear on the display panel 100 depending on the degree of expansion. Accordingly, the hidden data lines (Dn+1, Dm+1) may define hidden pixels (P1-1, P2-1), in addition to the pixels (P1, P2) defined by the scan lines (not illustrated) and the data lines (Dn, Dm) before the expansion, in accordance with the degree of expansion. Appearance of the hidden data lines (Dn+1, Dm+1) on the display panel 100 may depend on the degree of expansion of the display panel 100.

As the display panel 100 may further include the hidden data lines (Dn+1, Dm+1) arranged on the different layers of the flexible substrate from the data lines (Dn, Dm), second hidden signal lines (not illustrated) may be arranged on the different layers from the second signal lines 350 that electrically connect the display panel 100, the first data drive IC 310, and the second data drive IC 320. Thus, when the expansion of the display panel 100 is detected by the expansion detecting unit 400, the second hidden signal lines that electrically connect the display panel 100, the first data drive IC 310, and the second data drive IC 320, may appear depending on the degree of expansion of the display panel 100.

The expansion detecting unit 400 may include a single resistance line, a signal input terminal Tx configured to apply a pulse signal and disposed at one end of the resistance line, and a signal reception terminal Rx configured to receive the pulse signal input through the signal input terminal Tx and disposed at the other end of the resistance line. When the display panel 100 is expanded, a line width of the resistance line of the expansion detecting unit 400 may become thinner. Accordingly, the expansion detecting unit 400 may determine that the display panel 100 is expanded when a reception time, a time of which a pulse signal input through the signal input terminal Tx is received at the signal reception terminal Rx, is delayed compared to the reception time before the expansion. The expansion detecting unit 400 will be described in more detail below with reference to FIGS. 4 to 6.

Figure 4:
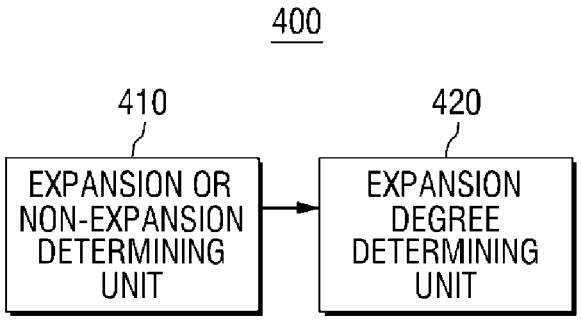
FIG. 4 is a block diagram schematically illustrating a configuration of an expansion detecting unit of FIG. 1.
Figure 5:
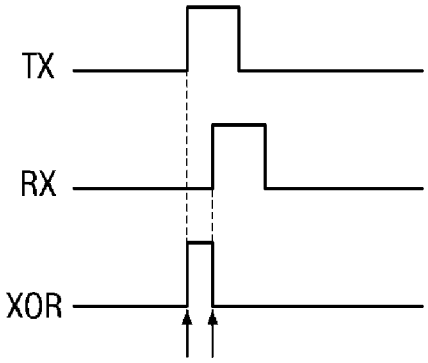
FIG. 5 is a timing diagram illustrating a change in signal level of the expansion detecting unit before expansion of the display device of FIG. 1.
Figure 6:
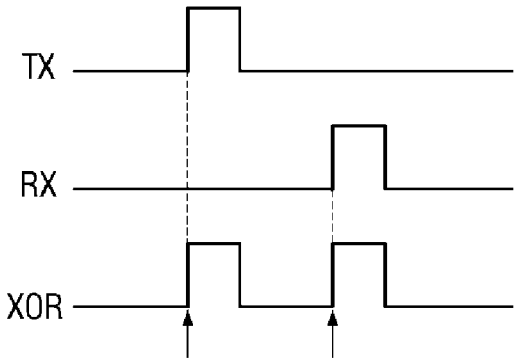
FIG. 6 is a timing diagram illustrating a change in signal level of the expansion detecting unit after expansion of the display device of FIG. 1.

FIG. 4 is a block diagram schematically illustrating a configuration of the expansion detecting unit of FIG. 1. FIG. 5 is timing diagram illustrating a change in a signal level of the expansion detecting unit before the expansion of the display device of FIG. 1. FIG. 6 is a timing diagram illustrating a change in a signal level of the expansion detecting unit after the expansion of the display device of FIG. 1.

Referring to FIG. 4, the expansion detecting unit 400 may include an expansion or non-expansion determining unit 410 and an expansion degree determining unit 420.

The expansion or non-expansion determining unit 410 may determine whether the display panel 100 is expanded by comparing a reception time of signal to a predetermined reference signal. The reception time may be a time of which a pulse signal or a clock signal input through the signal input terminal Tx is received at the signal reception terminal Rx. More particularly, when a pulse signal is input through the signal input terminal Tx, and the reception time of receiving the pulse signal at the signal reception terminal Rx is delayed than the predetermined reference time, the expansion or non-expansion determining unit 410 may determine that the display panel 100 is expanded. When the reception time is not delayed than the predetermined reference time, the expansion or non-expansion determining unit 410 may determine that the display panel 100 is not expanded. More particularly, as illustrated in FIG. 5, when the reception time of which the pulse signal input through the signal input terminal Tx is received at the signal reception terminal Rx is within a predetermined range of the reference time, the expansion or non-expansion determining unit 410 may determine that the display panel 100 is not expanded. Meanwhile, as illustrated in FIG. 6, when the reception time is not within the predetermined range of the reference time, the expansion or non-expansion determining unit 410 may determine that the display panel 100 is expanded.

The expansion degree determining unit 420 may include an XOR calculation unit. The XOR calculation unit may receive input values from the signal input terminal Tx and the signal reception terminal Rx to calculate an XOR value T. The input value of the signal input terminal Tx may be an input time of the pulse signal to the signal input terminal Tx, and the input value of the signal reception terminal Rx may be a reception time of the pulse signal at the signal reception terminal Rx. When the display panel 100 is determined to be expanded, the expansion degree determining unit 420 may compare the calculated XOR value T with a predetermined reference set value. When the calculated XOR value T is equal to or less than the predetermined reference set value, the expansion degree determining unit 420 may determine that the display panel 100 is expanded, but not to a degree that may render appearance of the hidden data lines (Dn+1, Dm+1), and correct an image accordingly. When the calculated XOR value T exceeds the predetermined reference set value, the expansion degree determining unit 420 may determine that the hidden data lines (Dn+1, Dm+1) appear while the display panel 100 is expanded, and correct the image accordingly.

According to an exemplary embodiment of the present invention, the reference set value may be determined by subdividing an output width of the XOR illustrated in FIGS. 5 and 6 into a small number of clocks, according to a setting based on the output width of the XOR. For example, when the number of the small clocks exceeds 100, the pixels are determined to be separated, and when the number of counts does not exceed 100, the pixels are determined not to be separated. Although it is not illustrated, the expansion or non-expansion determining unit 420 may include a look-up table (LUT) to determine a more accurate degree of expansion. Further, although the expansion degree determining unit 420 is described as being included in the expansion detecting unit 400, the expansion degree determining unit 420 may alternatively be included in the control unit 500.

Figure 7:
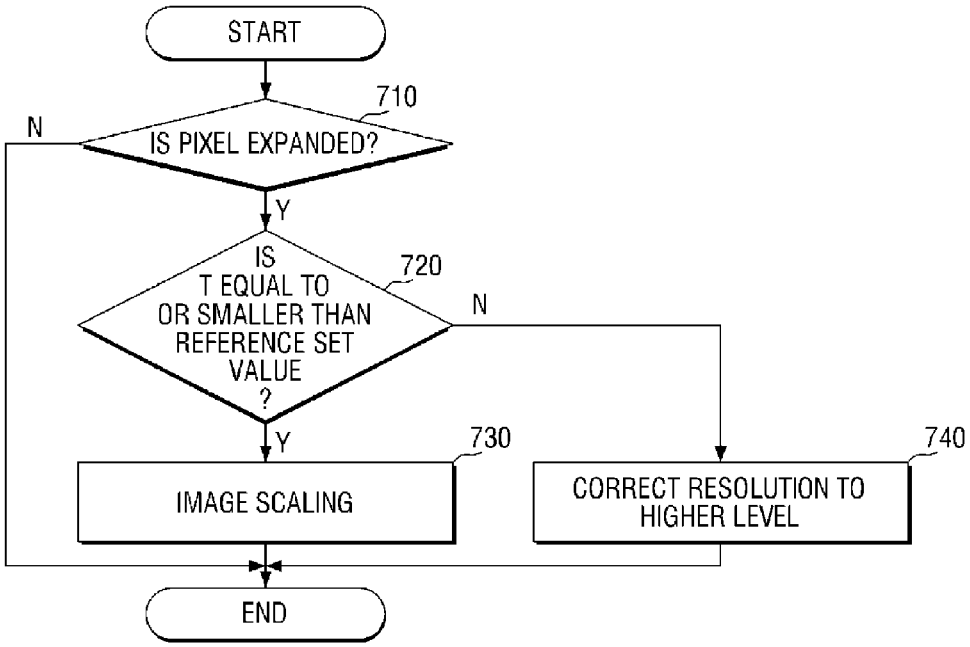
FIG. 7 is a flowchart illustrating a method of controlling the display device of FIG. 1.

FIG. 7 is a flowchart illustrating a method of controlling the display device of FIG. 1.

Referring to FIG. 7, in step 710, it is determined whether the display panel 100 is expanded by an external force. Whether the display panel 100 is expanded is determined by comparing a reception time of which a pulse signal input through the signal input terminal Tx is received at the signal reception terminal Rx to a predetermined reference time.

In step 720, when the display panel 100 is determined to be expanded, the values of the signal input terminal Tx and the signal reception terminal of Rx are input to calculate XOR T, and a degree of expansion may be determined by comparing the calculated XOR value T to a predetermined reference set value. The input value of the signal input terminal Tx may be an input time of the pulse signal to the signal input terminal Tx, and the input value of the signal reception terminal Rx may be a reception time of the pulse signal at the signal reception terminal Rx. If the calculated XOR value T is smaller than the predetermined reference set value, it is determined that the display panel 100 is expanded, but not to the degree rendering the hidden data lines (Dn+1, Dm+1) to appear in the display panel 100. Accordingly, in step 730, if the calculated XOR value T is smaller than the predetermined reference set value, only the scaling operation may be implemented to an image to be displayed on the display panel 100.

If the calculated XOR value T is greater than a predetermined reference value, it is determined that the hidden data lines (Dn+1, Dm+1) in the display panel 100 appear while the display panel 100 is expanded, so as to increase the number of pixels. Accordingly, in step 740, if the calculated XOR value T is greater than a predetermined reference set value, the image to be displayed on the display panel 100 may be corrected by increasing a resolution of the image to two to three times higher.

As described above, an image may be corrected by modifying a resolution of the image by comparing the predetermined reference set value, or by correcting the scaling.

Figure 8:
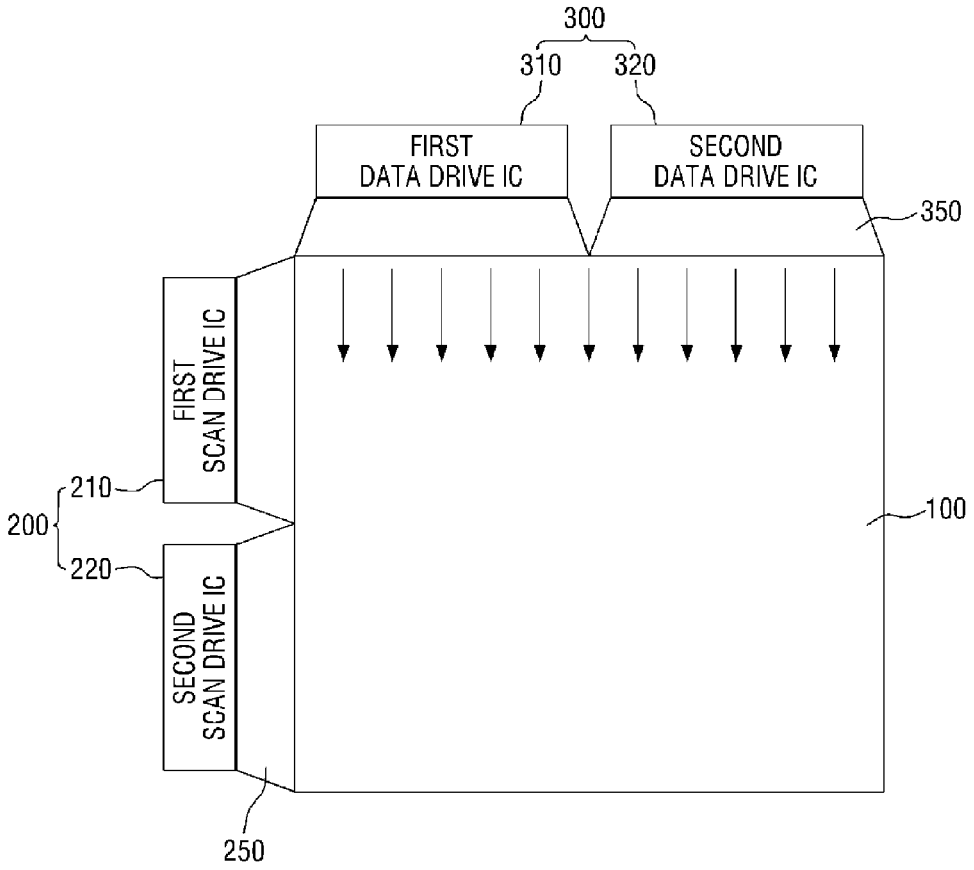
FIG. 8 is a plan view schematically illustrating application of signal to a display unit from a data drive unit before expansion of the display device according to an exemplary embodiment of the present invention.
Figure 9:
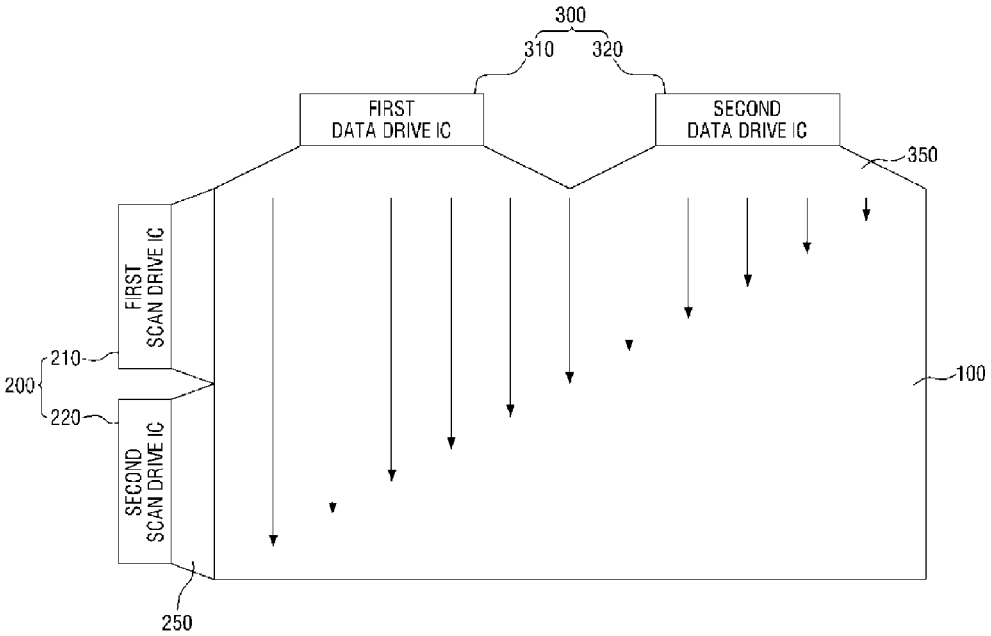
FIG. 9 is a plan view schematically illustrating application of signal to the display unit from the data drive unit after expansion of the display device according to an exemplary embodiment of the present invention.

FIGS. 8 and 9 illustrate a method of correcting an image when the expansion is detected by the expansion detecting unit 400, according to an exemplary embodiment of the present invention.

FIG. 8 is a plan view schematically illustrating a signal applied to the display panel from the data drive unit before the display device is expanded, and FIG. 9 is a plan view schematically illustrating a signal is applied to the display panel from the data drive unit after the display device is expanded.

As illustrated in FIG. 8, in the display device according to an exemplary embodiment of the present invention, when an expansion detecting unit 400 determines that the display panel 100 is not expanded, a control unit 500 may control the first data drive IC 310 and the second data drive IC 320 to apply a data signal to each pixels at the same timing.

Referring to FIG. 9, in the display device according to the present exemplary embodiment, when the expansion detecting unit 400 determines that the display panel 100 is expanded, a delayed time is calculated by comparing a difference between an input time of the pulse signal at the signal input terminal Tx of the expansion detecting unit 400 and the reception time of the pulse signal at the signal reception terminal Rx, to a reference value. The timing of the data signal applied to each pixel from the first data drive IC 310 and the second data drive IC 320 may be controlled depending on the calculated delayed time. More particularly, the data signal may be applied to each pixel at different timings in accordance to the delayed time. When the display panel 100 is expanded in a vertical direction, the control unit 500 may control the signal application timing of the first scan drive IC 210 and the second scan drive IC 220 according to the delayed time.

Accordingly, the display device according to an exemplary embodiment of the present invention may correct an image of the display panel 100 or control the application timing of the signal depending on the degree of expansion, by detecting the expansion of the display panel 100 from an external force and simultaneously determining the degree of expansion. Thus, it may be possible to prevent deterioration of the display quality when the display panel 100 is expanded by the external force.

Figure 10:
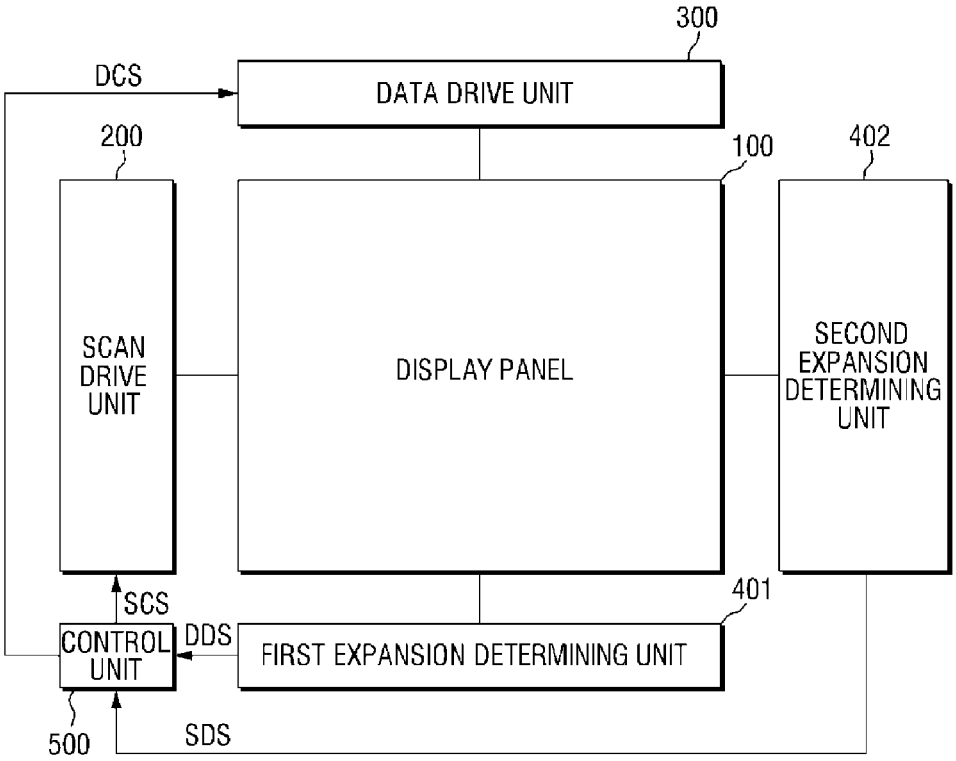
FIG. 10 is a block diagram schematically illustrating a display device according to an exemplary embodiment of the present invention.

FIG. 10 is a block diagram schematically illustrating a display device according to an exemplary embodiment of the present invention.

The display device of FIG. 10 has the same configuration as the display device 100 of FIG. 1, except for the configuration of the expansion detecting unit 400. Referring back to FIG. 1, the display device of FIG. 1 includes the expansion detection unit 400 disposed at the lower end of the display panel 100 to detect a horizontal expansion. The display device of FIG. 10 includes a first expansion detecting unit 401 and a second expansion detecting unit 402 disposed at a lower end portion and a side surface portion, to detect horizontal and vertical expansions. More particularly, the first expansion detecting unit 401 may detect the horizontal expansion, and the second expansion detecting unit 402 may detect the vertical expansion. Operations and elements of the first and second expansion detecting units 401 and 402 are substantially the same as the expansion detecting unit 400 illustrated with reference to FIGS. 4 to 6, and therefore, repeated description thereof will be omitted.

Figure 11:
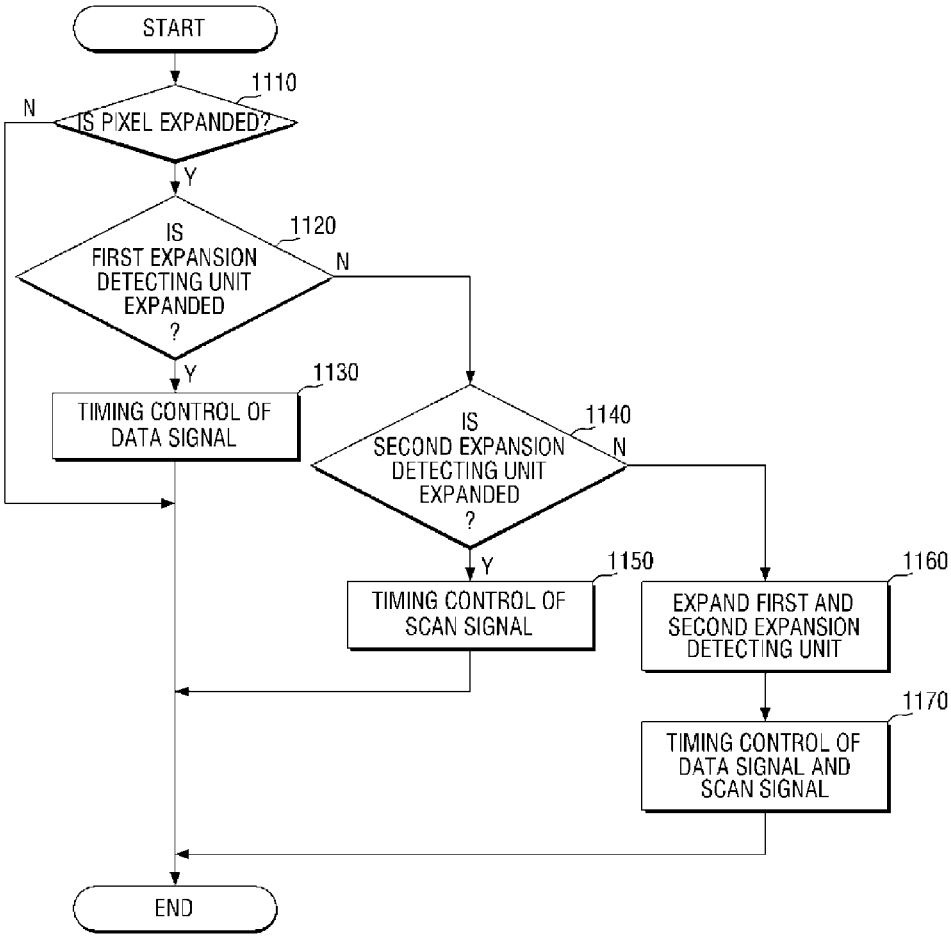
FIG. 11 is a flowchart illustrating a control method of the display device of FIG. 10.

FIG. 11 is a flowchart illustrating a control method of the display device of FIG. 10.

Referring to FIG. 11, in step 1110, it is determined whether the display panel 100 is expanded by an external force. Whether the display panel 100 is expanded or not may be determined by performing an XOR calculation on an input time of a pulse signal at the signal input terminal Tx and a reception time of the pulse signal at the signal reception terminal Rx, and if the calculated XOR value T is within a range of a reference value, the display panel 100 is determined not to be expanded, and when the calculated XOR value T exceeds the range of the reference value, the display panel 100 is determined to be expanded. When the display panel 100 is determined not to be expanded, an image signal may be output without correction.

When the display panel 100 is determined to be expanded, in step 1120, it is determined whether the first expansion detecting unit 401 is expanded. When the first expansion detecting unit 401 is determined to be expanded, in step 1130, the operations of the first data drive IC 310 and the second data drive IC 320 may be controlled to output the data signal to each pixel at different timing in accordance to a delayed time. The delayed time may be calculated by comparing a difference between the input time of the pulse signal at the signal input terminal Tx and the reception time of the pulse signal at the signal reception terminal Rx, to a second reference value.

In step 1140, when the first expansion detecting unit 401 determines that the display panel 100 is not expanded, it is determined whether the second expansion detecting unit 402 is expanded. When the second expansion detecting unit 402 determines that the display panel 100 is expanded, in step 1150, the operations of the first scan drive IC 210 and the second scan drive IC 220 may be controlled to output the scan signal to each pixel at different timing in accordance to the delayed time.

In step 1160, when the second expansion detecting unit 402 determines that the display panel 100 is not expanded, the first and second expansion detecting units 401 and 402 may determine that the display panel 100 is expanded both vertically and horizontally, and in step 1170, the operations of the first data drive IC 310, the second data drive IC 320, the first scan drive IC 210, and the second scan drive IC 220 may be controlled to output the data signal and the scan signal each pixel at different times according to the delayed time.

While FIG. 11 illustrates controlling the timing of the drive signal according to the detection of the expansion by the first expansion detecting unit 401 and the second expansion detecting unit 402, according to an exemplary embodiment of the present invention, the image signal may be corrected according to the delayed time, as illustrated with reference to FIG. 7.

Although certain exemplary embodiments and implementations have been described herein, other embodiments and modifications will be apparent from this description. Accordingly, the inventive concept is not limited to such exemplary embodiments, but rather to the broader scope of the presented claims and various obvious modifications and equivalent arrangements.

What is claimed is:

1. A display device, comprising:

a display panel comprising scan lines, data lines, and first pixels disposed thereon;

an expansion detecting unit comprising a resistance line configured to measure a time delay to determine expansion of the display panel;

a control unit configured to generate a control signal to correct an image signal depending on a degree of the expansion when the display panel is determined to be expanded;

a scan driver connected to the scan lines and configured to apply the control signal to the scan lines connected to the corresponding pixels according to the control signal from the control unit; and a data driver connected to the data lines and configured to apply the control signal to the data lines connected to the corresponding pixels according to the control signal from the control unit.

2. The display device of claim 1, wherein the display panel is disposed on a flexible substrate.

3. The display device of claim 1, wherein the expansion detecting unit comprises:

an expansion or non-expansion determining unit configured to determine the expansion of the display panel; and an expansion degree determining unit configured to determine the degree of expansion of the display panel when the display unit is determined to be expanded.

4. The display device of claim 3, wherein the expansion or non-expansion determining unit comprises:

the resistance line;

a signal input terminal disposed at one end of the resistance line to receive a pulse signal; and a signal reception terminal disposed at the other end of the resistance line to output the input pulse signal.

5. The display device of claim 4, wherein:

the expansion or non-expansion determining unit is configured to determine that the display panel is not expanded when a reception time is equal to or smaller than a first reference value, the reception time comprising a time period during which the pulse signal input to the signal input terminal is received at the signal reception terminal; and the expansion or non-expansion determining unit is configured to determine that the display panel is expanded when the reception time is greater than the first reference value.

6. The display device of claim 4, wherein the expansion degree determining unit comprises an XOR calculation unit configured to generate a calculated XOR value from input values of the signal input terminal and the signal output terminal.

7. The display device of claim 6, wherein the control unit is configured to determine the degree of the expansion of the display panel by comparing the calculated XOR value to a reference set value.

8. The display device of claim 7, wherein:

the control signal comprises a first control signal and a second control signal;

the control unit is configured to generate the first control signal when the calculated XOR value is smaller than the reference set value, the first control signal configured to correct scaling of the image signal to be displayed on the display panel; and the control unit is configured to generate the second control signal when the calculated XOR value is greater than the reference set value, the second control signal configured to increase a resolution of the image signal to be displayed on the display panel.

9. The display device of claim 1, wherein:

the display panel further comprises second scan lines and second data lines disposed on a different layer from the scan lines and the data lines so that the second scan lines and the second data lines are hidden when the display panel is not expanded; and the second scan lines and the second data lines are configured to appear on the display panel depending on the degree of the expansion of the display panel to define second pixels different from the first pixels.

10. The display device of claim 9, wherein the control signal is configured to increase a resolution of the image signal of the display panel when the display is determined to be expanded and the second scan lines and the second data lines are determined to appear on the display panel.

11. A display device, comprising:

a display panel comprising scan lines, data lines, and pixels disposed on the display panel in a region defined by the scan lines and the data lines;

an expansion detecting unit comprising a resistance line configured to measure a time delay to determine expansion of the display panel; and a control unit configured to generate a control signal and control the operation of a scan drive unit and a data drive unit depending on a degree of the expansion of the display panel when the display panel is determined to be expanded, wherein:

the scan drive unit is connected to the scan lines and configured to apply the control signal to the scan lines connected to the corresponding pixels depending on the control signal input from the control unit;

the data drive unit is connected to the data lines and configured to apply the control signal to the data lines connected to the corresponding pixels depending on the control signal input from the control unit; and the scan drive unit and the data drive unit are configured to control a timing of a scan signal or a data signal applied to the display panel depending on a degree of the expansion of the display panel.

12. The display device of claim 11, wherein the scan drive unit and the data drive unit are configured to delay a timing of applying the scan signal and the data signal, respectively, to the display panel according to the degree of the expansion of the display panel.

13. The display device of claim 11, wherein the expansion detecting unit comprises:

an expansion or non-expansion determining unit configured to determine expansion of the display panel; and an expansion degree determining unit configured to determine the degree of the expansion of the display panel when the display panel is determined to be expanded.

14. The display device of claim 13, wherein the expansion or non-expansion determining unit comprises:

the resistance line;

a signal input terminal disposed at one end of the resistance line to receive a pulse signal; and a signal reception terminal disposed at the other end of the resistance line to output the input pulse signal.

15. The display device of claim 14, wherein:

the expansion or non-expansion determining unit is configured to determine that the display panel is not expanded when a reception time is equal to or smaller than a first reference value, the reception time comprising a time the pulse signal input to the signal input terminal is received at the signal reception terminal; and the expansion or non-expansion determining unit is configured to determine that the display panel is not expanded when the reception time is greater than the first reference value.

16. The display device of claim 15, wherein the expansion degree determining unit comprises an XOR calculation unit configured to calculate the reception time of the pulse signal from the signal input terminal to the signal reception terminal and generate a calculated XOR value.

17. The display device of claim 16, wherein the control unit is configured to determine a delayed time based on the calculated XOR value and control a timing of applying the scan signal and the data signal to the display panel according to the delayed time.

18. A method of driving a display device, the method comprising:

determining whether the display panel is expanded by an external force such that a distance between adjacent pixels in the display panel is increased;

comparing a reference set value with a calculated value to determine a degree of expansion in response to determining that the display panel is expanded;

scaling an image signal when the reference set value is greater than the calculated value; and increasing a resolution of the image signal when the reference set value is smaller than the calculated value.

19. The method of claim 18, wherein determining whether the display panel is expanded by an external force comprises:

comparing an input time of a pulse signal applied to a first end of a resistance line and a reception time of the pulse signal from a second end of the resistance line to a reference time; and determining that the display panel is expanded when a time difference between the input time and the reception time is greater than the reference time.

20. The display device of claim 19, wherein the calculated value comprises an XOR calculated value of the input time of the pulse signal and the reception time of the pulse signal.

* * * * *